US005346224A

United States Patent [19]

Remus

[11] Patent Number: 5,346,224

[45] Date of Patent: Sep. 13, 1994

[54] PENALTY CHECKERS GAME

[76] Inventor: Karl G. Remus, 215 - 201 Joseph Street, Pembroke, Ontario, Canada

[21] Appl. No.: 150,807

[22] Filed: Nov. 12, 1993

[51] Int. Cl.[5] ..... A63F 3/02

[52] U.S. Cl. ..... 273/260

[58] Field of Search ..... 273/260, 255, 241, 262

[56] References Cited

U.S. PATENT DOCUMENTS 574,192 12/1896 Climenson ..... 273/260
613,550 11/1898 Ballou ..... 273/260
1,474,504 11/1923 Allen ..... 273/260
4,940,240 7/1990 Braley ..... 273/260

*Primary Examiner*—Benjamin H. Layno
*Attorney, Agent, or Firm*—W. Charles Kent; William R. Edgar; Burke-Robertson

[57] ABSTRACT

The present invention relates to a checker board game which introduces an element of chance whereby at predetermined times during play of the game, playing pieces on predetermined playing spaces must be removed.

9 Claims, 2 Drawing Sheets

PENALTY CHECKERS GAME

BACKGROUND OF THE INVENTION

The present invention relates to a checkers type board game, and more particularly relates to such a board game wherein an additional element of chance is added.

Conventionally checkers are played on a board having aligned vertical and horizontal rows of regular spaces, which form diagonal playing spaces. A plurality of checkers playing pieces are placed on the playing spaces, on opposite sides of the board, three rows deep, and the game progresses through alternative movement of the players' checkers playing pieces, the jumping of an opponents' playing piece resulting in loss of that piece to the opponent. The game is won by one player removing all of the other player's playing pieces from the board.

Variations on the game of checkers are known. U.S. Pat. No. 4,902,021 of Burroughs issued Feb. 20, 1990 teaches a checker and dice board game in which numbered checkers playing pieces correspond with numbers on a pair of thrown dice. The dice when thrown will determine what checkers qualify to be moved.

U.S. Pat. No. 4,546,981 of Elizondo issued Oct. 15, 1985 describes and illustrates a novel checker game board wherein rows of spaces may be rotated to the upper or lower surface of the board. The checkers playing pieces are releasably attachable to the playing spaces on the board. Rotating a row of spaces provides a continuously changing situation between the game playing pieces.

SUMMARY OF THE INVENTION

It is an object of the present invention to provide a novel type of checkers game introducing an element of chance whereby one or other of the checkers playing pieces may be randomly lost from play.

In accordance with the present invention, in addition to the conventional type checkers board and checkers playing pieces, each playing space of the board carries a distinctive identification code. A plurality of cards are also provided, each carrying a different identification code on a side, corresponding to one of the playing space identification code. During play of the game, selection and display of the identification code of a card results in removal of any playing piece situated on the space having an identification code corresponding to that of the selected card.

In a preferred embodiment, the game is further provided with a card display means arranged to produce a display of a card selected by a player after a predetermined number of moves of that player's playing pieces. This card display means is preferably a board having a surface on which are located a plurality of associated card—receiving spaces. Progressive movement of a selected card by a player from a starting one of the associated spaces to an ending one of the associated spaces is required before display of the card.

It is preferred that the identification codes for the playing spaces and cards be the numbers 1 to 32.

The game according to the present invention introduces an element of chance to the game which may enhance the player's enjoyment and create a different game strategy.

BRIEF DESCRIPTION OF THE DRAWINGS

These and other objects and advantages of the invention will become apparent upon reading the following detailed description and upon referring to the drawings in which.

Figure 1:
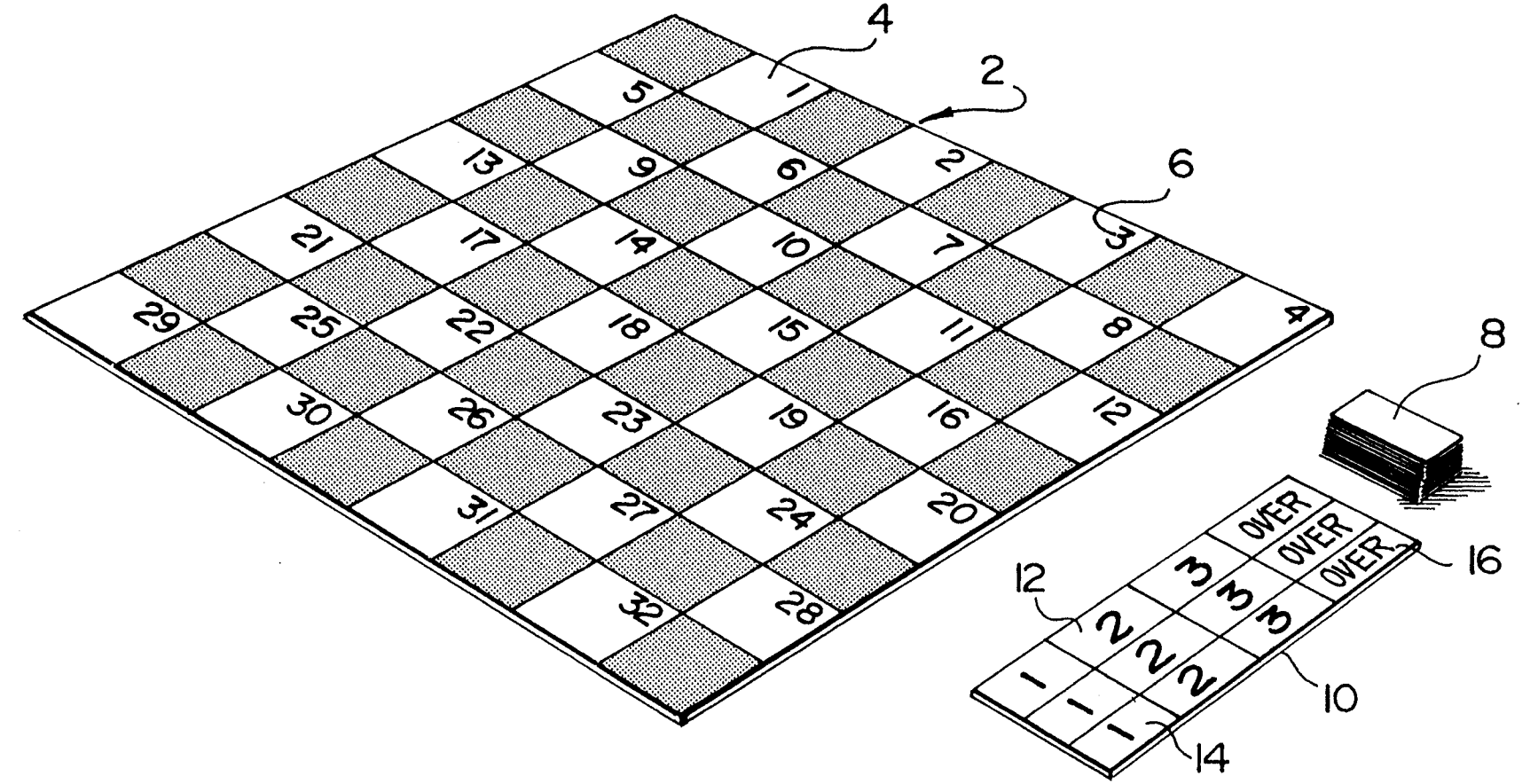
FIG. 1 is a perspective view of the components of a checkers game in accordance with the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Figure 2:
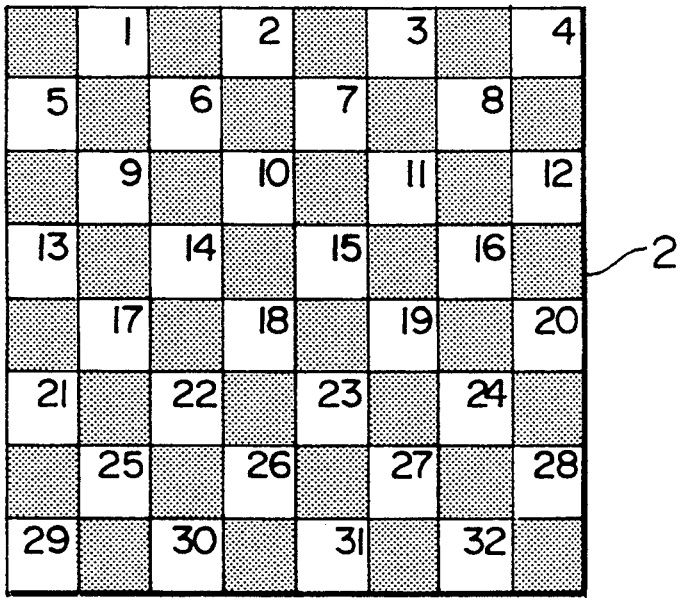
FIG. 2 is a plan view of the board carrying playing space identification codes.
Figure 3:
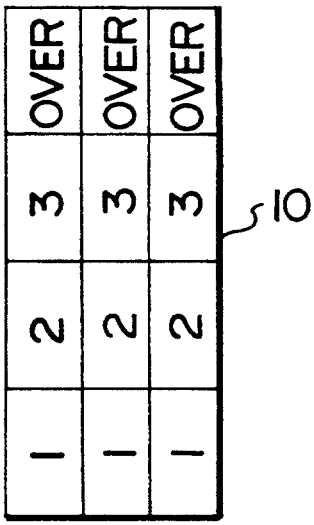
FIG. 3 is a plan view of the card display board in accordance with the present invention.
Figure 4:
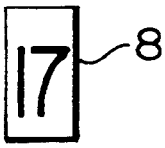
FIG. 4 is a plan view of an example embodiment of card in accordance with the present invention.

Turning to FIG. 1 there is illustrated a checkers type board game in accordance with the present invention comprising a checkers type board 2 having aligned vertical and horizontal rows of square spaces, forming diagonal playing spaces 4. Each diagonal playing space 4 carries a distinctive identification code 6, in the illustrated embodiment, as can be seen in FIG. 2, the numbers 1 to 32. A plurality of playing cards 8 are provided; in the illustrated embodiment 32 cards are provided, each card carrying a different number from 1 to 32 on a side (as illustrated in FIG. 4). A card display means 10 is provided in the form of a second board having a surface on which are located a plurality of corresponding, aligned card receiving spaces 12, intended for progressive movement of a selected card 8 by a player from a starting one 14 of the associated spaces 12, to an ending one 16 where the card may be turned over.

In a preferred form of play, each player, upon completing a move on board 2, must make a move as well with respect to card 8 and card receiving spaces 12 on board 10. The first move is to select one of the cards 8 and place it, face down, on the first space 14 of the associated corresponding card receiving spaces 12. Subsequent turns of the players then would require either the moving of the card, face down, one space at a time across the remaining three spaces, or the starting of another card on the starting space 14 of an unused row, or the moving of a card off the third space on to the last space 16 marked "over". When a card 8 is moved on to this "over" space 16, it is immediately turned face up and any checker which is on the space having the same number as the card, whether the players' own or that of the opponent, is removed from the checkerboard. The card 8 is then returned to the bottom of the pack and the vacated row may be again started.

It will be seen that, with this simple modification to a conventional checkers game, a significantly different game, providing a fast pace and additional elements of chance is provided.

Thus it is apparent that there has been provided in accordance with the invention penalty checkers game that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A checkers type board game comprising a checkers type board having aligned vertical and horizontal rows including diagonal rows of playing spaces, each playing space carrying a distinctive identification code, checkers playing pieces, and a plurality of cards, each carrying a different identification code on a side corresponding to one of the space identification code, whereby during play of the game, selection and display of the identification code of a card is to result in removal of any playing piece situated on the space having an identification code corresponding to that of the selected card.

2. A game according to claim 1 further comprising card display means arranged to produce a display of a card selected by a player after a predetermined number of moves of playing pieces by that player.

3. A game according to claim 2 wherein the card display means comprises a second board having a surface on which are located a plurality of associated card—receiving spaces, progressive movement of a selected card by the players from a starting one of the associated spaces to an ending one of the associated spaces being required before display of the card.

4. A game according to claim 3 wherein a plurality of distinctive associated card receiving spaces are provided.

5. A game according to claim 4 wherein a plurality group of four associated spaces are provided.

6. A game according to claim 5 wherein the identification code for the playing spaces and cards are numbers.

7. A game according to claim 6 wherein the playing spaces are sequentially numbered from 1 to 32.

8. A game according to claim 1 wherein the identification code for the playing spaces and cards are numbers.

9. A game according to claim 8 wherein the playing spaces are sequentially numbered from 1 to 32.

* * * * *